US010184462B2

(12) United States Patent
Stockner

(10) Patent No.: US 10,184,462 B2
(45) Date of Patent: Jan. 22, 2019

(54) DRIVE ASSEMBLY AND PUMP ASSEMBLY ARRANGEMENT FOR CRYOGENIC PUMP

(71) Applicant: Caterpillar Inc., Peoria, IL (US)

(72) Inventor: Alan R. Stockner, Metamora, IL (US)

(73) Assignee: Caterpillar Inc., Deerfield, IL (US)

( * ) Notice: Subject to any disclaimer, the term of this patent is extended or adjusted under 35 U.S.C. 154(b) by 567 days.

(21) Appl. No.: 14/934,593

(22) Filed: Nov. 6, 2015

(65) Prior Publication Data

US 2017/0130708 A1 May 11, 2017

(51) Int. Cl.

| | |
|---|---|
| ***F04B 53/14*** | (2006.01) |
| ***F04B 15/08*** | (2006.01) |
| ***F04B 9/02*** | (2006.01) |
| ***F04B 53/16*** | (2006.01) |
| ***F04B 1/12*** | (2006.01) |
| ***F04B 53/10*** | (2006.01) |

(52) U.S. Cl.

CPC ..... *F04B 15/08* (2013.01); *F04B 1/12* (2013.01); *F04B 9/02* (2013.01); *F04B 53/10* (2013.01); *F04B 53/14* (2013.01); *F04B 53/16* (2013.01); *F04B 2015/081* (2013.01)

(58) Field of Classification Search

CPC ..... F17C 2223/0161; F17C 2227/0135; F04B 37/08; F04B 2015/081; F04B 15/08; F04B 53/10; F04B 53/14; F04B 53/16; F04B 9/02; F04B 1/12; F02D 19/0647

USPC ..... 417/901, 489

See application file for complete search history.

(56) References Cited

U.S. PATENT DOCUMENTS

| | | | | | |
|---|---|---|---|---|---|
| 2,855,859 | A * | 10/1958 | Petzold | F04B 15/08 | 417/513 |
| 3,315,490 | A * | 4/1967 | Berry | F25B 9/14 | 60/522 |
| 4,681,516 | A * | 7/1987 | O'Hara | F04B 15/00 | 417/259 |
| 5,797,734 | A | 8/1998 | Kizer et al. | | |
| 6,082,980 | A | 7/2000 | Papin | | |
| 6,354,088 | B1 * | 3/2002 | Emmer | F17C 5/007 | 141/82 |
| 6,488,478 | B2 * | 12/2002 | Ono | F04B 1/122 | 417/269 |
| 6,722,866 | B1 * | 4/2004 | Dresler | F04B 9/02 | 417/269 |
| 2003/0068243 | A1 * | 4/2003 | Nelson | F04B 1/2014 | 417/490 |
| 2007/0009367 | A1 * | 1/2007 | Tischler | F04B 1/124 | 417/269 |

* cited by examiner

*Primary Examiner* — Patrick Hamo

(74) *Attorney, Agent, or Firm* — Leydig, Voit & Mayer, LTD.

(57) ABSTRACT

A cryogenic pump for pumping cryogenic fluid is provided. The pump includes a pump assembly adapted for exposure to cryogenic fluid that includes a plurality of pumping elements disposed about a pump axis. A drive assembly drives the pumping elements to pump cryogenic fluid. A plurality of actuating elements are arranged circumferentially about the pump axis, each actuating element operatively interconnecting the drive assembly with a respective one of the pumping elements. Each actuating element includes a first portion disposed a first radial distance from the pump axis and a second portion disposed a second radial distance from the pump axis with the first radial distance being less than the second radial distance at ambient temperature.

20 Claims, 2 Drawing Sheets

DRIVE ASSEMBLY AND PUMP ASSEMBLY ARRANGEMENT FOR CRYOGENIC PUMP

TECHNICAL FIELD

This disclosure relates generally to cryogenic pumps and, more particularly, to an arrangement of a drive assembly and a pump assembly for a cryogenic pump.

BACKGROUND

Many large mobile machines such as mining trucks, locomotives, marine applications and the like have recently begun using alternative fuels, alone or in conjunction with traditional fuels, to power their engines. For example, large displacement engines may use a gaseous fuel, alone or in combination with a traditional fuel such as diesel, to operate. Because of their relatively low densities, gaseous fuels, for example, natural gas or petroleum gas, are carried onboard vehicles in liquid form. These liquids, the most common including liquefied natural gas (LNG) or liquefied petroleum gas (LPG), can be cryogenically stored in insulated tanks on the vehicles, or may alternatively be stored at an elevated pressure, for example, a pressure between 30 and 300 psi in a pressurized vessel. In either case, the stored fuel can be pumped, evaporated, expanded, or otherwise placed in a gaseous form in metered amounts and provided to fuel the engine.

To store and utilize cooled natural gas in compressed or liquefied forms onboard mobile machines, specialized storage tanks and fuel delivery systems may be required. This equipment may include a double-walled cryogenic tank and a pump for delivering the LNG or LPG to the internal combustion engine for combustion. The pumps that are typically used to deliver the LNG to the engine of the machine include pistons, which deliver the LNG to the engine. Such piston pumps, which are sometimes also referred to as cryogenic pumps, will often include a single piston that is reciprocally mounted in a cylinder bore. The piston is moved back and forth in the cylinder to draw in and then compress the gas. Power to move the piston may be provided by different means, the most common being electrical, mechanical or hydraulic power.

The cryogenic pumps used in these types of applications may be configured with a cold end and a warm end. The cold end is generally the end which does the pumping of the LNG or LPG and, as such, comes into contact with the cryogenic fluid. The warm end of the cryogenic pump generally contains many of the pump driving elements and may be exposed to atmospheric temperatures. This temperature difference between the cold end and the warm end of the cryogenic pump can create issues with respect to the design and operation of such pumps.

U.S. Pat. No. 5,797,734 ("the '734 patent") discloses a gear type hydraulic pump that purports to be designed to pump both extremely hot fluids and extremely cold fluids. The '734 patent indicates that to avoid issues with regard to radial thermal expansion and contraction, the support housing, the inner rotor and outer rotor may be constructed of the same material and with the same thickness such that all three elements may have the same response to changes in temperature. While this arrangement may help alleviate issues caused by exposing the entire pump to different temperatures, it does not address issues caused by exposing different portions of the same pump to significantly different temperature such as with the warm end and the cold end of a cryogenic pump.

SUMMARY

In one aspect, the disclosure describes a cryogenic pump for pumping cryogenic fluid. The pump includes a pump assembly adapted for exposure to cryogenic fluid. The pump assembly includes a plurality of pumping elements disposed about a pump axis. A drive assembly drives the pumping element to pump cryogenic fluid. A plurality of actuating elements are arranged circumferentially about the pump axis. Each actuating element operatively interconnects the drive assembly with a respective one of the pumping elements. Each actuating element includes a first portion arranged relatively closer to the drive assembly than a second portion and a second portion arranged relatively closer to the pump assembly than the first portion. The first portion of the actuating element is disposed a first radial distance from the pump axis and the second portion of the actuating element is disposed a second radial distance from the pump axis with the first radial distance being less than the second radial distance at ambient temperature.

In another aspect, the disclosure describes a cryogenic pump for pumping cryogenic fluid including a pump assembly adapted for exposure to cryogenic fluid. The pump assembly includes a plurality of pumping elements disposed about a pump axis. A drive assembly drives the pumping elements to pump cryogenic fluid. A plurality of actuating elements are arranged circumferentially about the pump axis with each actuating element operatively interconnecting the drive assembly with a respective one of the pumping elements. Each actuating element includes a first portion arranged relatively closer to the drive assembly than a second portion and a second portion arranged relatively closer to the pump assembly than the first portion. The first portion of the actuating element is disposed a first radial distance from the pump axis and the second portion of the actuating element is disposed a second radial distance from the pump axis with the first radial distance being less than the second radial distance at ambient temperature. The first radial distance and second radial distance are selected such that the first portion and second portion of the actuating element are in substantially coaxial alignment parallel to the pump axis when the cryogenic pump is pumping cryogenic liquid.

In yet another aspect, the disclosure describes a cryogenic pump for pumping cryogenic fluid that includes a pump assembly adapted for exposure to cryogenic fluid. The pump assembly includes a plurality of pumping elements disposed about a pump axis. A drive assembly drives the pumping elements to pump cryogenic fluid. A plurality of actuating elements are arranged circumferentially about the pump axis. Each actuating element operatively interconnects the drive assembly with a respective one of the pumping elements. A first portion of each actuating element is supported in the first housing for reciprocal sliding movement parallel to the pump axis. A second portion of each actuating element is supported in the second housing for reciprocal sliding movement parallel to the pump axis The first housing is arranged relatively closer to the drive assembly than the second housing and the second housing is arranged relatively closer to the pump assembly than the first housing. The first housing is configured such that the first portion of the actuating element is disposed a first radial distance from the pump axis and the second housing is configured such that the second portion of the actuating element is disposed a second radial distance from the pump axis with the first radial distance being less than the second radial distance at ambient temperature. The first radial distance and second radial distance are selected such that the first portion and second portion of the actuating element are in substantially coaxial alignment parallel to the pump axis when the cryogenic pump is pumping cryogenic liquid.

DETAILED DESCRIPTION

Figure 1:
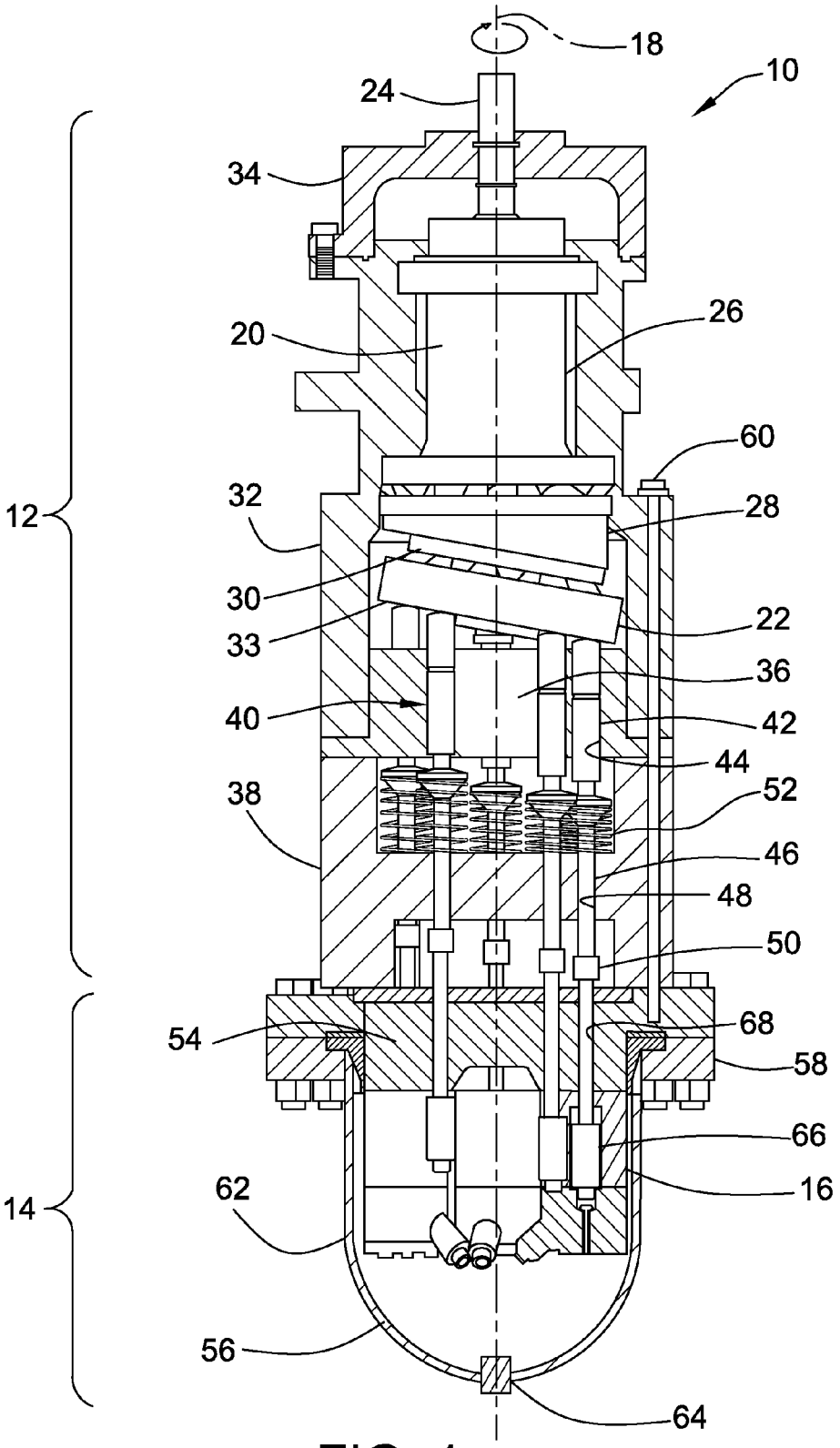
FIG. 1 is a partially cross sectioned side view of an exemplary cryogenic pump according to the present disclosure.

This disclosure generally relates to a cryogenic pump 10 and, more particularly, to an arrangement of a drive assembly 12 and a pump assembly 14 of the pump. With reference to FIG. 1 of the drawings, an exemplary cryogenic pump 10 according to the present disclosure is shown. The cryogenic pump 10 of FIG. 1 may be configured to pump fluids at cryogenic temperatures, such as temperatures of less than minus 100 degrees Celsius. In one exemplary application, the cryogenic pump 10 can be configured as a pump for drawing LNG from a tank, pressurizing it, and delivering it to an engine at high pressure. LNG is normally stored at temperatures of between about minus 240 degrees F. (minus 150 degrees C.) and minus 175 degrees F. (minus 115 degrees C.) and at pressures of between about 15 and 200 psig (204 and 1477 kPa) in a cryogenic tank. The engine, for example, may be on a machine such as a large mining truck or a locomotive. The high pressure LNG from the cryogenic pump may be vaporized into a gaseous form by a heat exchanger before it is introduced into the engine. Of course, those skilled in the art will appreciate that the cryogenic pump 10 of the present disclosure is not limited to applications involving the pumping of LNG or LPG or, more particularly, engine fuel delivery systems. Instead, the cryogenic pump 10 of the present disclosure can be used in any application involving the pumping of a cryogenic liquid.

With reference to FIG. 1 of the drawings and as noted above, the pump 10 may be generally configured with a drive assembly 12 and a pump assembly 14. In the illustrated embodiment, the pump assembly 14 of the cryogenic pump 10 is the lower portion of the pump and generally includes the pump components that are intended to come into contact with the cryogenic fluid during operation of the pump including a pump inlet and a pump outlet. The end of the pump including the pump assembly 14 is sometimes referred to as the cold end of the pump 10. The drive assembly 12 of the illustrated pump is the upper portion of the pump and generally includes one or more driving components of the pump that are not intended to contact the cryogenic fluid during operation of the pump. The end of the pump including the drive assembly 12 is sometimes referred to as the warm end of the pump. The components in the pump assembly 14 of the pump 10 may be constructed of materials rated for cryogenic service, while the components in the drive assembly 12 may be constructed of conventional materials. Those skilled in the art will appreciate that the pump 10 may have orientations different than that shown in FIG. 1.

To pump the cryogenic fluid, the pump assembly 14 may include a plurality of pumping elements 16 that may be configured to produce a reciprocating pumping action and to thereby move the cryogenic fluid. The pumping elements 16 may move in a sequential and alternating manner to provide a consistent output of cryogenic fluid from the pump 10. In an embodiment, the pump assembly 14 may include six pumping elements 16 arranged concentrically about a longitudinal axis 18 of the cryogenic pump 10, but in other embodiments, different numbers and arrangements of pumping elements 16 are contemplated and fall within the scope of the disclosure.

As further shown in FIG. 1, in one embodiment, the drive assembly 12 may include a rotatable shaft 20 and a wobble plate 22. The rotatable shaft 20 may be connected at its upper end to a stub shaft 24 that protrudes outward from the pump housing. The stub shaft 24 may be operatively coupled to any suitable prime mover capable of producing a rotary output such as, for example, an electric or hydraulic motor or a diesel or gasoline engine. The shaft 20 may include a drive shaft portion 26 and an offset shaft portion 28, the drive shaft portion 26 being proximally disposed relative to the stub shaft 24 and the offset shaft portion 28 being distally disposed. The shaft 26 may be supported for rotation about the longitudinal axis 18 of the pump by a bearing arrangement 30 that may include various bearings assemblies.

At the end opposite the stub shaft 24, in this case the distal or lower end, the shaft 20 may be operatively connected to the wobble plate 22 so as to drive movement thereof. In the illustrated embodiment, the wobble plate 22 may be supported on the offset shaft portion 28 and within a bearing housing 32 for wobbling movement about the center of the wobble plate 22. The shaft 20 may be operatively connected to the wobble plate 22 in such a manner that rotation of the shaft 20 drives the wobbling movement of the wobble plate 22 as the shaft 20 rotates relative to the wobble plate 22. The wobble plate 22 includes a distal contact surface 33.

With reference to FIG. 1, the pump 10 may include a housing cap 34, the bearing housing 32, a tappet housing 36 and a pushrod housing 38. In the illustrated embodiment, the wobble plate 22 and the rotatable shaft 20 may be contained within the bearing housing 32. It will be appreciated that the arrangement of the various housings is exemplary, and one or more of the housings 32, 34, 36, 38 may have a structure other than as illustrated. For example, the bearing housing 32 may be formed of two or more bearing housing portions (not illustrated). Similarly, while separate housings 32, 34, 36, 38 are illustrated, a single housing may be provided. Starting from the upper end of the pump 10 as shown in FIG. 1, the housing cap 34 may be connected to an upper end of the bearing housing 32, while a lower end of the bearing housing 32 is connected to the tappet housing 36. The lower end of the tappet housing 36 may, in turn, be connected to the pushrod housing 38, which, in the illustrated embodiment, defines the lower end of the drive assembly 12 of the pump 10.

To drive the pumping elements 16, the drive assembly 12 may be configured to convert rotation of the stub shaft 24 into reciprocal motion that is directed generally parallel with the pump axis 18. To this end, a plurality of actuating elements 40 may be provided that operatively interconnect the wobble plate 22 and the pumping elements 16. In particular, an actuating element 40 may be provided for each of the pumping elements 16. According to one embodiment, the actuating elements 40 may include a plurality of tappets 42 each of which is slidably disposed in the tappet housing 36 for movement in two directions (up and down with reference to the arrangement of FIG. 1) parallel to the longitudinal axis 18. Each tappet 42 may be arranged immediately beneath the wobble plate 22, with an upper end of each tappet 42 in contact with the contact surface 33 of the wobble plate 22. Reciprocal movement of the tappets 42 may be driven by the wobble plate 22. More specifically, the wobble plate 22 may be supported at a transverse angle relative to the longitudinal axis 18 of the pump 10 such that wobbling movement of the wobble plate 22 drives reciprocal movement of the tappets 42.

Each of the tappets 42 may have an elongate configuration and be supported for longitudinal movement in a respective tappet bore 44 in the tappet housing 36. The tappet housing 36 can include a plurality of vertically arranged tappet bores 44 disposed therein and extending circumferentially around the pump axis 18, with the number of tappet bores 44 corresponding to the number of tappets 42. Like the tappet bores 44, the tappets 42 installed therein are circumferentially arranged around the pump axis 18. It will be appreciated that the number of tappets 42 and the number of tappet bores 44 may correspond to the number of pumping elements 16 in the pump assembly 14, for example, six.

Each actuating element 40 may further include one or more pushrods. According to one embodiment, a lower end of each tappet 42 may abut or engage a corresponding upper pushrod 46 that, in turn, abuts or engages at its lower end with a corresponding lower push rod 50. Each upper pushrod 46 may be supported in a corresponding opening 48 in the pushrod housing 38 for movement in the longitudinal direction of the upper pushrod 46 in response to a force applied at the upper end thereof by the tappet 42. The upper and lower pushrods 46, 50 can be distributed circumferentially around the pump axis 18. The number of upper pushrods 46 accommodated in the pushrod housing 38 and, accordingly, the number of pushrod openings 48 can be the same as the number of pumping elements 16 in the pump assembly 14, for example, six. Longitudinal movement of the upper pushrods 46, in turn, applies a force on the lower pushrods 50 that drives movement of the respective lower pushrod 50 in the longitudinal direction. In this case, downward or distal movement of each tappet 42 and upper pushrod 46 may be counter to the force of a respective spring 52 arranged, for example, in a cavity of the pushrod housing 38 to drive the upper pushrod 46 and tappet 42 back upward when the force applied by the wobble plate 22 is relieved by rotation of the plate.

While the drive assembly 12 of the illustrated embodiment includes a wobble plate that is rotatably driven by a shaft in order to produce the reciprocal longitudinal movement of the actuating elements 40, differently configured drive assemblies also may be used. For example, a hydraulic drive assembly may be provided that includes a plurality of valves that selectively direct pressurized hydraulic fluid to and from chambers that are arranged and configured such that the movement of the hydraulic fluid into and out of each chamber produces reciprocal movement of a respective actuating element 40.

The pump assembly 14 of the pump 10 may include a manifold 54 and a reservoir 56. For the sake of clarity, all of the details of the internal structure of the pump assembly 14 are not illustrated in the exemplary embodiment. For example, the internal structure of the manifold 54 is not illustrated in detail inasmuch as it is not pertinent to the present disclosure. It will be appreciated, however, that an intake may be provided through the manifold 54 to allow an opening for cryogenic fluid, e.g., LNG, to enter. In the specific illustrated embodiment, the manifold 54 may be arranged at the lower end of the pushrod housing 38, while the reservoir 56 may be attached to the lower side of the manifold 54. To facilitate connection between the manifold 54 and the reservoir 56, the reservoir 56 may have an annular retainer 58 at the upper end thereof that abuts against an outer portion of the lower surface of the manifold 54 and is secured thereto, for example, by fasteners. The manifold 54, in turn, may be connected to the pushrod housing 38 by one or more tie rods 60 (one is shown in FIG. 1) that extend through the bearing housing 32, the tappet housing 36 and the pushrod housing 38 and into the manifold 54. The reservoir 56 may include a outer vacuum jacket 62 that has an vacuum port 64 at its lower end. In the illustrated embodiment, the reservoir 56 may further house the plurality of pumping elements 16 each of which defines an inlet for the pump 10. According to one embodiment, at least a portion of each pumping element 16 may be submerged in cryogenic fluid contained in the reservoir 56.

The actuating element 40 associated with each of the pumping elements 16 may further include a plunger 66 arranged in the corresponding pumping element 16. In particular, the lower pushrod 50 of each actuating element 40 may extend downward through a corresponding passage 68 through the manifold 54 and into a corresponding one of the pumping elements 16 where it engages with the plunger 66 arranged in the pumping element 16. With this arrangement, movement of the lower pushrod 50 (as driven by the wobble plate 22 through the corresponding tappet 42 and upper pushrod 46) can drive movement of the plunger 66. Movement of the plunger 66, in turn, draws the cryogenic fluid into the pumping element 16 and pressurizes it. The pressurized cryogenic fluid may then be directed into the manifold 54 which defines the outlet for the pressurized fluid from the pump 10. The upper and lower pushrods 46, 50 are shown here for illustrative purposes. Those skilled in the art will appreciate that any number of pushrod elements could be used between each tappet 42 and its corresponding plunger 66, including an arrangement where the tappet 42 and plunger 66 are operably disposed or connected to each other.

During operating conditions, various portions of the cryogenic pump 10 may be exposed to different temperatures. For example, some or all of the pump assembly 14 at the cold end of the cryogenic pump may be exposed to cryogenic fluid having a temperature of minus 115 degrees C. to minus 160 degrees C. In contrast, portions of the drive assembly 12 at the warm end of the cryogenic pump 10 may be exposed to temperatures higher than ambient temperature, for example temperatures of 60 degrees C. to 90 degrees C. These elevated temperatures may be caused by friction losses and/or lubricant temperatures in the drive assembly 12. As a result of these temperature differences, various portions of the cryogenic pump 10 will expand and/or contract to different degrees. In order to account for the different degrees of thermal expansion and/or contraction, one or more of the actuating elements 40 of the pump 10 may be arranged and configured such that different portions of the actuating element 40 are radially offset from each other with respect to the longitudinal axis 18 of the pump at ambient temperature. In other words, each actuating element 40 may include portions, for example a first portion, having centerlines that are spaced a different radial distance from the longitudinal axis 18 of the pump than the centerlines of other portions of the actuating element 40, for example a second portion, when the pump 10 is at ambient temperature.

More particularly, the radial position of each tappet 42 may be defined by the position of the corresponding tappet bore 44 in the tappet housing 36 in which the tappet is received while the radial position of each upper pushrod 46 may be defined by the position of the corresponding opening 48 in the pushrod housing 38 in which it is received. Similarly, the radial position of the lower pushrod 50 and plunger 66 may be defined respectively by the corresponding passage 68 in the manifold 54 and the position of the corresponding pumping element 16. During operation of the pump 10, the tappet housing 36, pushrod housing 38 and manifold 54 may be exposed to different temperatures causing them to expand and/or contract to different degrees. Such expansion and contraction may move the corresponding openings in the tappet housing 36, pushrod housing 38 and manifold 54 within which the tappets 42 and upper and lower pushrods 46, 50 are received causing the tappets and upper and lower pushrods to be displaced relative to each other in the radial direction relative to the longitudinal axis 18. For example, the cold temperature to which the pump assembly 14 is exposed during operation may cause the manifold 54 to contract thereby moving the lower pushrods 50 and plungers 66 relatively closer to the longitudinal axis 18 of the pump than they were at ambient temperature. Conversely, the warmer temperature that the drive assembly 12 is exposed during operation may cause the tappet housing 36 and/or pushrod housing 38 to expand thereby moving the tappets 42 and/or the upper pushrods 46 relatively farther away from the longitudinal axis 18 of the pump than they were at ambient temperature.

Figure 2:
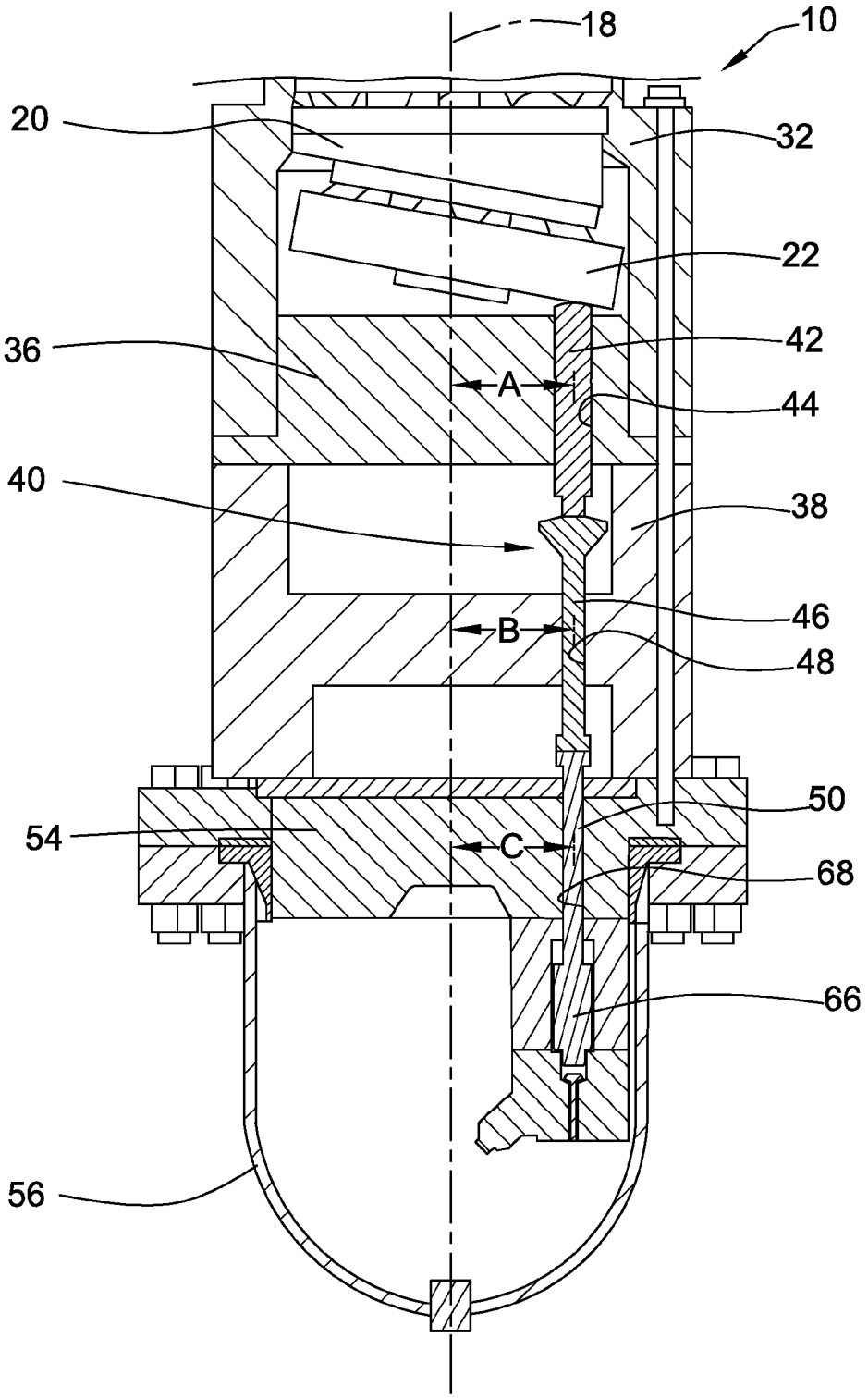
FIG. 2 is a schematic, partial, side sectional view of the cryogenic pump of FIG. 1 showing the arrangement of one actuating element.

To compensate for this expansion and contraction so as to bring the components of the actuating elements 40 into substantial axial alignment during operating conditions (i.e., when pumping cryogenic liquid), the tappet housing 36, pushrod housing 38 and manifold 54 may be configured such that the centerlines (i.e., longitudinal axes) of the tappets 42 and upper pushrods 46 are arranged radially closer to the longitudinal axis 18 of the pump than the centerlines (i.e., longitudinal axes) of the lower pushrods 50 and plungers 66 when the pump 10 is at ambient temperature. An exemplary illustration of the different radial spacings of different portions of one actuating element 40 is shown schematically in FIG. 2. In FIG. 2, the centerline of the tappet 42 is spaced a radial distance A from the longitudinal axis 18 of the pump, the centerline of the upper pushrod 46 is spaced a radial distance B from the longitudinal axis 18 of the pump and the centerlines of the lower pushrod 50 and plunger 66 are spaced a radial distance C from the longitudinal axis 18 of the pump. According to one embodiment, the tappet 42 and upper pushrod 46 may be spaced a relatively smaller radial distance from the longitudinal axis 18 of the pump than the lower pushrod 50 and plunger 66 at ambient temperature, i.e. radial distance A and/or B may be less than radial distance C). In some embodiments, the radial distance A and radial distance B also may be different from each other at ambient temperature, e.g., the radial distance A may be relatively smaller than the radial distance B. The radial distances A, B and C may be selected so as to bring all of the components of the actuating element 40 into axial alignment when the pump 10 is under operating conditions pumping a cryogenic liquid. The relative radial movement of the components of the actuating elements 40 that occurs when the pump goes from ambient temperature to operating conditions may be accommodated by configuring the interfaces between the components such that they allow radial slippage of the components relative to each other. According to one example, the magnitude of the differences between the radial distances A, B and C at ambient temperature may be determined based on the respective materials of construction of the tappet housing 36, pushrod housing 38 and manifold 54 and the average temperature to which such components are exposed during normal operating conditions of the pump 10. In one embodiment, the offset in the radial distance between the warm and cold ends of the pump at ambient temperature may be less than approximately 1 mm and, more particularly, less than approximately 0.5 mm. A person of skill in the art will appreciate that the amount of offset necessary to bring the warm and cold portions of the actuating elements into coaxial alignment may vary based on a number of different factors including the materials of construction of the various components, the temperature of the cryogenic fluid being pumped and the relative size of the pump including the relative distance of the actuating elements from the centerline of the pump.

INDUSTRIAL APPLICABILITY

The hydraulic drive assembly and pump assembly arrangement of the present disclosure is applicable to a variety of different cryogenic pump configurations. The present disclosure is particularly applicable to radial, multi-piston cryogenic pumps in which there is a substantial axial displacement between the location where the force is applied to the actuating elements by the drive assembly and the pumping elements. In such circumstances, the temperature difference between the drive assembly and the pump assembly can lead to expansion and/or contraction of the pump housings that creates a significant side force or thrust load on the pumping elements. These side loads can result in increased wear and/or failure of the pumping elements and actuating elements. Configuring the pump housings such that at ambient temperature the portion of the actuating elements in the drive assembly (i.e., the warm end) are radially offset from the portion of the actuating elements in the pump assembly (i.e., the cold end) can help eliminate these side loads and improve the life span of the actuating elements and the pumping elements.

This disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A cryogenic pump for pumping cryogenic fluid comprising:

a pump assembly adapted for exposure to cryogenic fluid, the pump assembly including a plurality of pumping elements disposed about a pump axis;

a drive assembly for driving the pumping elements to pump cryogenic fluid; and a plurality of actuating elements arranged circumferentially about the pump axis, each actuating element operatively interconnecting the drive assembly with a respective one of the pumping elements;

wherein each actuating element includes a first portion arranged relatively closer to the drive assembly than a second portion with the second portion arranged relatively closer to the pump assembly than the first portion, the first portion of the actuating element having a first longitudinal axis which is disposed a first radial distance from the pump axis and the second portion of the actuating element having a second longitudinal axis which is disposed a second radial distance from the pump axis with the first radial distance being less than the second radial distance at ambient temperature.

2. The cryogenic pump of claim 1 wherein each actuating element includes a tappet and a pushrod.

3. The cryogenic pump of claim 2 wherein the first portion of the actuating element includes at least a portion of the tappet and the second portion of the actuating element includes at least a portion of the pushrod.

4. The cryogenic pump of claim 2 wherein the pushrod includes an upper pushrod and a lower pushrod.

5. The cryogenic pump of claim 4 wherein each actuating element includes a plunger operatively arranged in a respective one of the pumping elements.

6. The cryogenic pump of claim 1 wherein the first portion of the actuating element is supported in a first opening in a first housing for sliding movement in directions parallel to the pump axis and the second portion of the actuating element is supported in a second opening in a second housing for sliding movement in directions parallel to the pump axis.

7. The cryogenic pump of claim 6 wherein with the first opening defines the first radial distance and the second opening defines the second radial distance.

8. The cryogenic pump of claim 1 wherein the drive assembly includes a rotatable wobble plate with each actuating element being in operative engagement with the wobble plate.

9. A cryogenic pump for pumping cryogenic fluid comprising:

a pump assembly adapted for exposure to cryogenic fluid, the pump assembly including a plurality of pumping elements disposed about a pump axis;

a drive assembly for driving the pumping elements to pump cryogenic fluid; and a plurality of actuating elements arranged circumferentially about the pump axis, each actuating element operatively interconnecting the drive assembly with a respective one of the pumping elements;

wherein each actuating element includes a first portion arranged relatively closer to the drive assembly than a second portion with the second portion arranged relatively closer to the pump assembly than the first portion, the first portion of the actuating element having a first longitudinal axis which is disposed a first radial distance from the pump axis and the second portion of the actuating element having a second longitudinal axis which is disposed a second radial distance from the pump axis with the first radial distance being less than the second radial distance at ambient temperature, the first radial distance and second radial distance being selected such that the first portion and second portion of the actuating element are in substantially coaxial alignment parallel to the pump axis when the cryogenic pump is pumping cryogenic liquid.

10. The cryogenic pump of claim 9 wherein each actuating element includes a tappet and a pushrod.

11. The cryogenic pump of claim 10 wherein the first portion of the actuating element includes at least a portion of the tappet and the second portion of the actuating element includes at least a portion of the pushrod.

12. The cryogenic pump of claim 10 wherein the pushrod includes an upper pushrod and a lower pushrod.

13. The cryogenic pump of claim 12 wherein each actuating element includes a plunger operatively arranged in a respective one of the pumping elements.

14. The cryogenic pump of claim 9 wherein the first portion of the actuating element is supported in a first opening in a first housing for sliding movement in directions parallel to the pump axis and the second portion of the actuating element is supported in a second opening in a second housing for sliding movement in directions parallel to the pump axis.

15. The cryogenic pump of claim 14 wherein with the first opening defines the first radial distance and the second opening defines the second radial distance.

16. The cryogenic pump of claim 9 wherein the drive assembly includes a rotatable wobble plate with each actuating element being in operative engagement with the wobble plate.

17. A cryogenic pump for pumping cryogenic fluid comprising:

a pump assembly adapted for exposure to cryogenic fluid, the pump assembly including a plurality of pumping elements disposed about a pump axis;

a drive assembly for driving the pumping elements to pump cryogenic fluid; and a plurality of actuating elements arranged circumferentially about the pump axis, each actuating element operatively interconnecting the drive assembly with a respective one of the pumping elements;

a first housing, a first portion of each actuating element being supported in the first housing for reciprocal sliding movement parallel to the pump axis; and a second housing, a second portion of each actuating element being supported in the second housing for reciprocal sliding movement parallel to the pump axis, the first housing being arranged relatively closer to the drive assembly than the second housing and the second housing being arranged relatively closer to the pump assembly than the first housing;

wherein the first housing is configured such that a first longitudinal axis of the first portion of the actuating element is disposed a first radial distance from the pump axis and the second housing is configured such that a second longitudinal axis of the second portion of the actuating element is disposed a second radial distance from the pump axis with the first radial distance being less than the second radial distance at ambient temperature, the first radial distance and second radial distance being selected such that the first portion and second portion of the actuating element are in substantially coaxial alignment parallel to the pump axis when the cryogenic pump is pumping cryogenic liquid.

18. The cryogenic pump of claim 17 wherein each actuating element includes a tappet and a pushrod.

19. The cryogenic pump of claim 18 wherein the first portion of the actuating element includes at least a portion of the tappet and the second portion of the actuating element includes at least a portion of the pushrod.

20. The cryogenic pump of claim 17 wherein the drive assembly includes a rotatable wobble plate with each actuating element being in operative engagement with the wobble plate.

* * * * *